US008908878B2

(12) United States Patent
Hägglund et al.

(10) Patent No.: US 8,908,878 B2
(45) Date of Patent: Dec. 9, 2014

(54) ARRANGEMENTS IN A DEVICE FOR USE WITH A SERVICE INVOLVING PLAY OUT OF MEDIA AND RELATED METHODS

(75) Inventors: Caroline Hägglund, Stockholm (SE); Cristian Norlin, Stockholm (SE); Marcus Nyberg, Hägersten (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 353 days.

(21) Appl. No.: 13/512,433

(22) PCT Filed: Nov. 30, 2009

(86) PCT No.: PCT/SE2009/051354

§ 371 (c)(1),
(2), (4) Date: May 29, 2012

(87) PCT Pub. No.: WO2011/065879

PCT Pub. Date: Jun. 3, 2011

(65) Prior Publication Data

US 2012/0230509 A1 Sep. 13, 2012

(51) Int. Cl.

| | |
|---|---|
| ***H04R 5/033*** | (2006.01) |
| ***H04R 1/10*** | (2006.01) |
| *H04R 3/00* | (2006.01) |

(52) U.S. Cl.

CPC ..... *H04R 1/1041* (2013.01); *H04R 3/00* (2013.01); *H04R 5/033* (2013.01)

USPC ..... 381/74; 381/370

(58) Field of Classification Search

USPC ..... 381/74, 370, 384

See application file for complete search history.

(56) References Cited

U.S. PATENT DOCUMENTS

| | | | |
|---|---|---|---|
| 2006/0045304 | A1 | 3/2006 | Lee et al. |
| 2006/0233413 | A1 | 10/2006 | Nam |

(Continued)

FOREIGN PATENT DOCUMENTS

| | | | |
|---|---|---|---|
| EP | 2 190 213 | A1 | 5/2010 |
| WO | WO 2008/000304 | A1 | 12/2006 |
| WO | WO 2007/049255 | A2 | 5/2007 |

OTHER PUBLICATIONS

International Search Report, PCT/SE2009/051354, Jul. 29, 2010.
Written Opinion, PCT/SE2009/051354, Jul. 29, 2010.
International Preliminary Report on Patentability, PCT/SE2009/051354, Oct. 24, 2011.

(Continued)

*Primary Examiner* — Duc Nguyen
*Assistant Examiner* — George Monikang
(74) *Attorney, Agent, or Firm* — Myers Bigel Sibley & Sajovec

(57) ABSTRACT

Arrangements in a device for use with a service involving play out of audio from a headset are provided. The arrangements include an application for providing the play out of audio to a user of the device. The application has at least two modes of operation including first and second active modes. In the first active mode, the headset is in full physical contact with the user. In the second active mode, the headset may not be in full physical contact with the user. The application is configured to switch between the first and second modes of operation based on whether the headset is detected to be in full physical contact with the user. In the first active mode, the user is entitled to full use and/or operation of the service. In the second active mode, the user is entitled to modified use and/or operation of the service. Related methods are also provided.

10 Claims, 2 Drawing Sheets

(56) References Cited

U.S. PATENT DOCUMENTS

| | | | | |
|---|---|---|---|---|
| 2007/0147629 | A1 | 6/2007 | Chiloyan | |
| 2009/0226013 | A1 | 9/2009 | Burge | |
| 2010/0020998 | A1 * | 1/2010 | Brown et al. | 381/380 |

OTHER PUBLICATIONS

Extended European Search Report, PCT/SE2009/051354, Apr. 22, 2013.

* cited by examiner

ARRANGEMENTS IN A DEVICE FOR USE WITH A SERVICE INVOLVING PLAY OUT OF MEDIA AND RELATED METHODS

CROSS-REFERENCE TO RELATED APPLICATION

This application is a 35 U.S.C. §371 national stage application of PCT International Application No. PCT/SE2009/051354, filed on Nov. 30, 2009, the disclosure and content of which is incorporated by reference herein as if set forth in its entirety. The above-referenced PCT International Application was published in the English language as International Publication No. WO 2011/065879on Jun. 3, 2011.

TECHNICAL FIELD

The present invention relates generally to an arrangement in a device for use with a service involving play out of media, and a method for controlling play out of media.

BACKGROUND

Today's electronic devices evolve rapidly, especially portable electronic devices. One of the trends lately is that they are capable of providing or supporting a variety of multimedia or entertainment services, such as play out of audio and/or video. Some examples of such devices are mobile telephones, Personal Digital Assistants (PDAs), mp3-players, laptops and so on.

Very often, the user of an electronic device and hence a service provided by it, starts utilising the service, e.g. listening to audio from a radio broadcast or an mp3 file using a headset connected to the electronic device, and then puts the device away in a pocket or bag. If the user is interrupted, he/she must then take out the device from the pocket or bag and manipulate it in order to stop the play out and remove the headset before being able to engage in another activity called for by the interruption. Assume the play out is an audio book, the user most probably does not want during further play out to just remove the headset not hearing what is being read and thus "losing" information before stopping the play out.

Once the user wants to resume his/her use of the service, he/she must then manipulate the electronic device in order to start the play out again. In case the user has lost some information that is "recoverable", e.g. by rewinding the audio file, the user may have to find the point in time in the play out sequence where he/she was interrupted. In case the user was listening to, e.g. a real time radio broadcast or podcast, the information is permanently lost.

There is a problem with existing electronic devices concerning the ease of use of the device. The manipulation of the device in order to control it and the services provided by it may be cumbersome and constitute a source of irritation for the user.

There is another problem, caused by the cumbersome use of the device, that information may be lost for the user of the device.

SUMMARY

It is an object of the invention to address at least some of the problems outlined above. In particular, it is an object of the invention to provide an arrangement in a device for use with a service involving play out of audio from a headset, and a method for controlling play out of audio from a headset connected to a user device.

According to one aspect, an arrangement in a device for use with a service involving play out of audio from a headset is provided. The arrangement comprises an application for providing the play out of audio to a user of the device, and the application has at least two modes of operation including a first active mode and a second active mode. The first active mode corresponds to the headset being in full physical contact with the user and the second active mode corresponds to the headset being in less than full physical contact with the user. The detection of full physical contact of the headset with the user causes the application to be in the first active mode and detection of less than full physical contact of the headset with the user causes the application to switch to the second active mode. The first active mode entails full use and/or operation of the service and the second active mode entails modified use and/or operation of the service.

Thereby, the modes can be adapted to the status of the physical contact of the headset with the user, thereby customizing the device to optimize the user experience of the use of the service.

According to an embodiment of the arrangement, the first active mode corresponds to full operation of a microphone and speakers of said headset, and when the application switches to the second active mode, audio signals from the microphone of the headset are discarded so as to mute the microphone of the headset.

According to another embodiment of the arrangement, the device is used for listening to a radio broadcast or podcast and the first active mode corresponds to playing the radio broadcast or podcast to the user in real time through speakers in the headset. The detection of less than full physical contact of the headset with the user causes the application to switch to the second active mode, wherein the radio broadcast or podcast is recorded in the device.

Thereby, the user is able to recover any possible lost information due to the total or partial removal of headset.

According to one example, a subsequent detection of full physical contact of the headset with the user causes the application to start a playback of the recorded radio broadcast or podcast from the point in time when less than full physical contact of the headset with the user was detected.

According to another embodiment of the arrangement, the first active mode corresponds to operating speakers of the headset in stereo and the detection of less than full physical contact of the headset with the user causes the application to switch to the second active mode corresponding to operating speakers of the headset in mono.

In this way, the play out of audio may be customized and/or optimized in dependence of the physical contact of the headset with the user so that the user may always experience the best possible play out of audio.

In yet another embodiment, the first active mode corresponds to playing out audio from the headset using a first bitrate and/or a first compression scheme and the detection of less than full physical contact of the headset with the user causes the application to switch to the second active mode, wherein the audio is played out from a speaker in the device using a second bitrate and/or a second compression scheme.

This is another possible way of customizing and/optimizing the play out of media in dependence of the physical contact of the headset with the user so that the user may always experience the best possible play out of audio.

According to another aspect, a method for controlling play out of audio from a headset connected to a user device is provided. The method comprises detecting full physical contact of said headset with a user or less than full physical contact of the headset with a user. The the detection of full physical contact of the headset with the user causes an application in the user device to operate in a first active mode, which entails full use and/or operation of said play out of audio, and the detection of less than full physical contact of the headset with the user causes said application in the user device to operate in a second active mode, which entails modified use and/or operation of said play out of audio.

According to an embodiment of the method, the first active mode corresponds to full operation of a microphone and speakers of said headset. When the application switches to the second active mode, audio signals from the microphone of the headset are discarded to as to mute the microphone of the headset.

According to another embodiment of the method, the user device is used for listening to a radio broadcast and the first active mode corresponds to playing the radio broadcast to the user in real time through speakers in the headset. The detection of less than full physical contact of the headset with the user causes the application to switch to the second active mode, wherein the radio broadcast is recorded in the device.

According to one example, a subsequent detection of full physical contact of the headset with the user causes the application to start a playback of the recorded radio broadcast from the point in time when less than full physical contact of the headset with the user was detected.

In yet another embodiment of the method, the detection of full physical contact of the headset with the user causes the application to be in the first active mode corresponding to operating speakers of the headset in stereo. The detection of less than full physical contact of the headset with the user causes the application to switch to the second active mode corresponding to operating speakers of the headset in mono.

According to one embodiment of the method, the detection of full physical contact of the headset with the user causes the application to operate in the first active mode corresponding to playing out audio from the headset using a first bitrate and/or a first compression scheme. The detection of less than full physical contact of the headset with the user causes the application to switch to the second active mode, wherein the audio is played out from a speaker in the device using a second bitrate and/or a second compression scheme.

Further possible features and benefits of the invention will be explained in the detailed description below.

BRIEF DESCRIPTION OF THE DRAWINGS

The invention will now be described in more detail by means of preferred embodiments and with reference to the accompanying drawings, in which.

DETAILED DESCRIPTION

Briefly described, an arrangement in a device for use with a service involving play out of media, and a method for controlling play out of media are provided.

Figure 1:
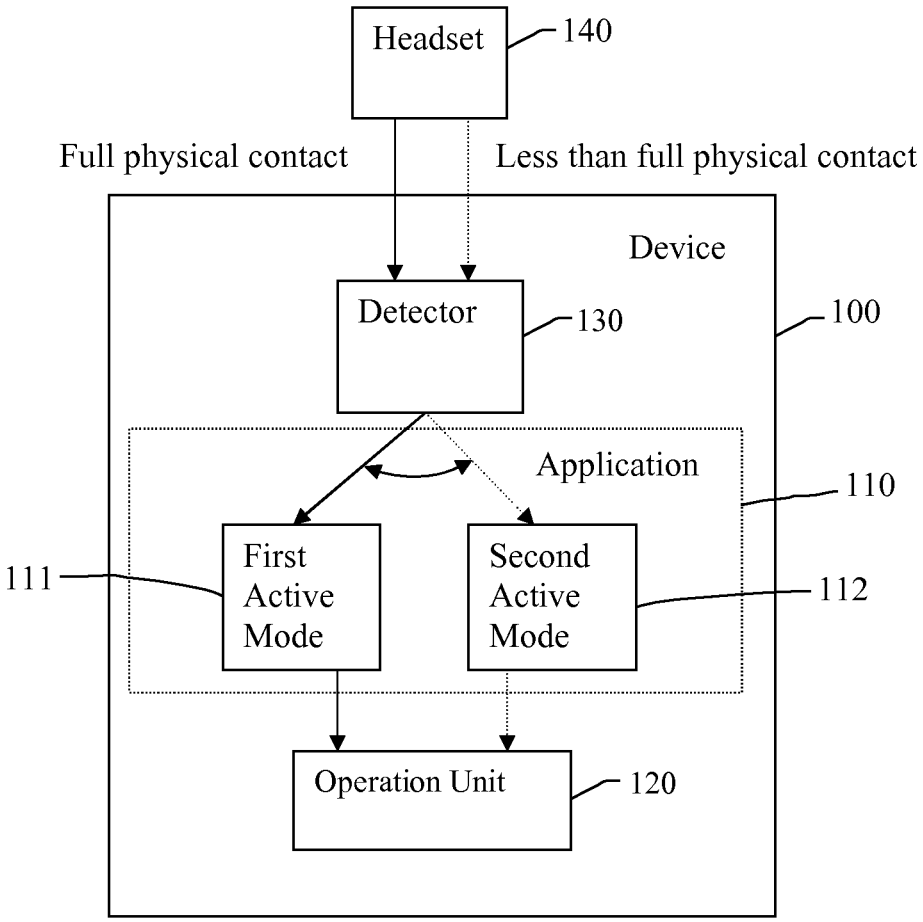
FIG. 1 is a logical representation of an arrangement in a device for use with a service involving play out of media.

FIG. 1 illustrates a logical representation of an embodiment of an arrangement in a device 100 for use with a service involving play out of audio from a headset 140. The arrangement in a device 100 comprises an application 110 for providing play out of audio to a user of the device 100, wherein the application 110 has at least two modes of operation including a first active mode 111 and a second active mode 112. The first active mode 111 corresponds to the headset 140 being in full physical contact with the user and the second active mode 112 corresponds to the headset 140 being in less than full physical contact with the user. The detection of full physical contact of the headset 140 with the user causes the application 110 to be in the first active mode 111 and the detection of less than full physical contact of the headset 140 with the user causes the application 110 to switch to the second active mode 112. The first active mode 111 entails full use and/or operation of the service and the second active mode 112 entails modified use and/or operation of the service.

The headset 140 may comprise one or two earpieces, wherein an earpiece comprises a speaker that emits sound when the application 110 plays out audio. In case the headset 140 comprises one earpiece, full physical contact of the headset 140 with the user corresponds to the earpiece being in full physical contact with the user, such as being inserted into the ear of the user. Less than full physical contact with the user corresponds to the earpiece being removed from the ear of the user.

In case the headset 140 comprises two earpieces, full physical contact of the headset 140 with the user corresponds to both earpieces being in full physical contact with the user, such as being inserted into the ears of the user. Less than full physical contact corresponds to at least one of the earpieces being removed from the ears of the user.

By configuring the application 110 with at least two active modes 111 and 112 associated with the physical contact of the headset 140 with the user, it is possible to switch modes depending on the status of the headset 140. As the headset 140 is in full physical contact, full use and/or operation of the service is provided. As the user removes the earphone(s) from his/her ear(s), the mode of operation of the application 110 is changed to the second active mode 112, which entails modified use and/or operation of the service. The second modified use and/or operation of the service may entail different features, depending on the current service the user is utilising.

FIG. 1 also discloses an Operation Unit 120. In the logical representation of the device 100 illustrated in FIG. 1, the application 110 controls the operation unit 120 so as to control the function or operation of the device and/or service. It shall be noted that the operation unit 120 does not necessarily have to be implemented as a separate unit, but may be implemented in the application 110.

Figure 2:
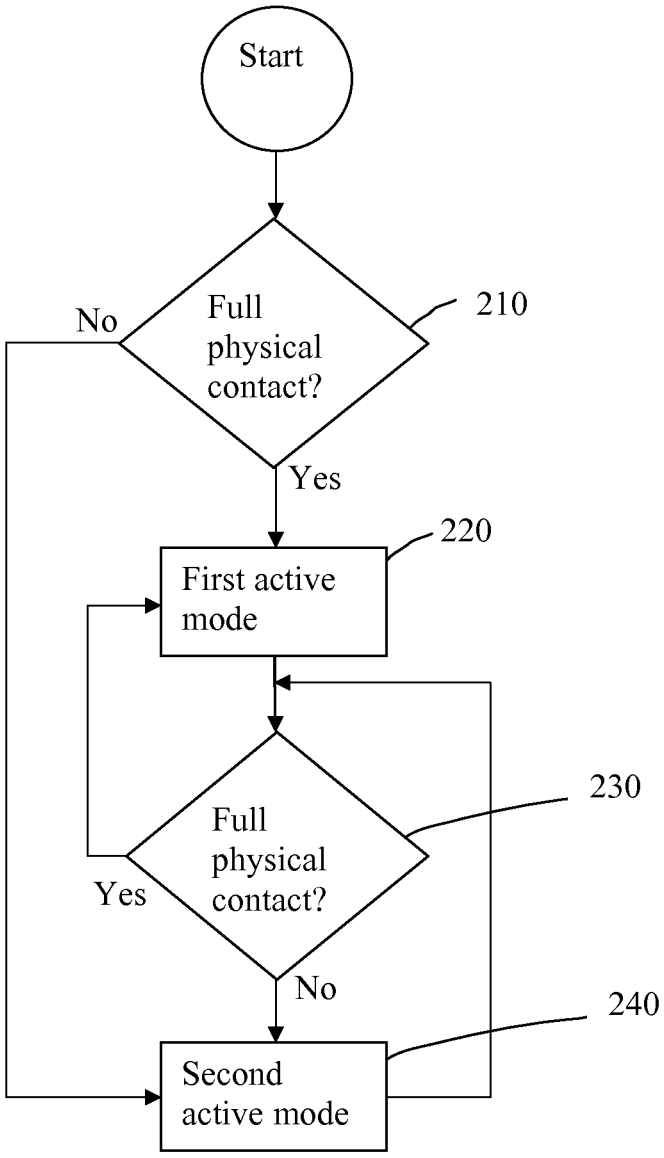
FIG. 2 is a flowchart of a method for controlling play out of audio according to an embodiment.

FIG. 2 is a flowchart of a method for controlling play out of audio according to one exemplary embodiment. As described above, the full or less than full physical contact of the headset 140 with a user thereof is associated with two separate active modes of operation of the application 110, i.e. the first active mode 111, 220 and the second active mode 112, 240. The detection of change in physical contact 210, 230 of the headset 140 with a user thereof will cause a change of active mode in the application controlling the service being in use.

When a use of a service is commenced, it is first detected 210 if the headset 140 is in full physical contact with the user of the device 100 that is used. If the headset 140 is in full physical contact with the user, the application 110 will operate in the first active mode 111, 220. If the headset 140 is in less than full physical contact with the user, the application 110 will operate in the second active mode 112, 240. Thereafter, any detection of a change in physical contact 230 of the headset 140 with the user will cause the application 110 to change operation mode.

In one embodiment, the first active mode 111, 220 corresponds to full operation of a microphone and speakers of the headset 140, and when the application switches to the second active mode 112, 240, audio signals from the microphone of the headset 140 are discarded to as to mute the microphone of the headset 140.

Assume the user is engaged in a conference call involving at least two other persons or participants. The user is using a headset 140 connected to a laptop or a mobile phone, constituting the device 100 described above, for this conference call. Also assume the headset 140 has two earpieces, both being inserted in the ears of the user. The user is interrupted by another person needing the user's attention. When detecting that one earpiece is removed, the application 110 in the laptop or mobile phone controlling the service switches operation mode from the first active mode 111, 220 to the second active mode 112, 240. In the second active mode 112, 240, audio signals from the microphone of the headset 140 are discarded so as to mute the microphone of the headset 140. This means that the user may still be able to hear the other persons talking, not missing out on anything being said, but also his/her microphone is muted so that the user may speak freely to the interrupting person without the other participants in the conference call being able to hear what the user is saying. When detecting that the currently removed earpiece of the headset 140 is re-inserted in the user's ear, the application 110 switches operation mode to the first active mode 111, 220, corresponding to regained full operation of the microphone and speakers of the headset 140 so that the other participants may again hear what the user is saying.

Of course, in the example above, the headset 140 may comprise just one earpiece and the removal of it from the ear of the user will in the same manner mute the microphone of the headset 140.

According to another embodiment, the device 100 is used for listening to a radio broadcast or podcast and the first active mode 111, 220 corresponds to playing the radio broadcast or podcast to the user in real time through speaker(s) in the headset 140. The detection of less than full physical contact 210, 230 of the headset 140 with the user causes the application 110 to switch to the second active mode 112, 240, wherein the radio broadcast or podcast is being recorded in the device 100.

This embodiment improves the controlling and manipulation of the electronic device 100, and thus improves user experience. Also, it is ensured that the user will not lose any information being consumed by listening to the broadcast. From the point in time when less than full physical contact is detected 210, 230, the broadcast information is recorded in the device, as the application 110 switches to the second active mode 112, 240, ensuring the user will not lose any information.

A subsequent detection of full physical contact 230 of the headset 140 with the user causes the application 110 to start a playback of the recorded radio broadcast or podcast from the point in time when less than full physical contact of the headset 140 with said user was detected and the recording was commenced.

Although the playback is commenced, the radio broadcast or podcast is still being recorded until the current broadcast has ended. Should the user again remove the earpiece(s) so that less than full physical contact is detected, the playback will pause and be resumed when the full physical contact is again detected.

In yet another embodiment, the first active mode 111, 220 corresponds to operating speakers of the headset 140 in stereo, i.e. the audio information in one speaker is different from that in the other speaker. The detection of less than full physical contact 210, 230 of the headset 140 with the user causes the application 110 to switch to the second active mode 112, 240 corresponding to operating the speakers of the headset 140 in mono, such that the audio information is the same in both speakers. Thereby, no audio information will be missed by the user.

It may be the case that the play out should not be stopped, paused or recorded due to less than full physical contact of the headset 140 with the user thereof. Assume a user is listening to music using a headset 140 with two earpieces. When in full physical contact with the user thereof, corresponding to both earpieces being inserted into the ears of the user, the music is played out in stereo. As the user removes at least one of the earpieces of the headset 140 from his or her ear, the operation mode of the application 110 is switched to the second active mode 112, 240, entailing playing out the music in mono. This ensures that the user may still listen to the music without parts of it being lost due to the play out of those parts in the earpiece that has been removed. The play out in mono can be done in both earpieces regardless of which one is being removed. The play out in mono may also be performed only in the earpiece still being inserted in the ear of the user.

As the user re-inserts the removed earpiece into his or her ear, the operation mode of the application 110 is switched to the first active mode 111, 220 and the play out of the music is again performed in stereo.

According to one embodiment, the first active mode 111, 220 corresponds to playing out audio from the headset 140 using a first bitrate and/or a first compression scheme and the detection of less than full physical contact 210, 230 of the headset 140 with the user causes the application 110 to switch to the second active mode 112, 240, wherein the audio is played out from a speaker in the device 100 using a second bitrate and/or a second compression scheme.

Different speakers typically require quite different bitrates and/or compression schemes in order to play out audio. The better quality of the speaker or speakers, the higher bitrate and/or compression scheme may be required in order to make use of the speaker's full potential.

For example, a user is using a headset 140 for listening to music from an mp3-player or a mobile telephone, which also comprises a speaker in its housing. The application 110 is operating in the first active mode 111, 220 playing out the audio using a first bitrate and/or a first compression scheme. The speakers of the headset 140 are usually of a good quality and may require or be able to reproduce audio using a high bitrate and/or certain compression scheme. As the user removes the headset 140, the application 110 switches to the second active operation mode 112, 240. In this example, the second active mode 112, 240 entails playing out the audio from the speaker in the housing of the device 100, such as an mp3-player or a mobile telephone, using a second bitrate and/or a second compression scheme. Assume the speaker in the device 100 is of somewhat mediocre quality, or at least less than the quality of the speakers of the headset 140. Then the speaker of the device 100 cannot reproduce the audio with the same quality as the speakers of the headset 140. Then, it might be the case that the speaker of the device 100 may operate better with another bitrate and/or compression scheme than the speakers of the headset 140. By this embodiment, it is possible to make better use of the resources available in the device and to ensure that the operating speaker(s) is/are provided with the optimal available bitrate and/or compression scheme depending on the quality and characteristics of the speaker(s).

It shall be noted that the design of the headset lies outside of the invention. It may be designed as to have insertable earpieces, it may alternatively be designed as to have cushions surrounding the ear(s) or any other design or configuration so that physical contact of the headset with a user is detectable.

While the invention has been described with reference to specific exemplary embodiments, the description is generally only intended to illustrate the inventive concept and should not be taken as limiting the scope of the invention. The present invention is defined by the appended claims.

The invention claimed is:

1. An arrangement in a device for use with a service involving play out of audio from a headset having two earpieces, comprising:

an application for providing the play out of audio to a user of the device, wherein the application has at least two modes of operation including a first active mode and a second active mode;

wherein the first active mode corresponds to the headset being in full physical contact with the user corresponding to the two earpieces being in full physical contact with the user;

wherein the second active mode corresponds to the headset being in less than full physical contact with the user corresponding to at least one of the two earpieces being removed from an ear of the user;

wherein detection of full physical contact of the headset with the user causes the application to be in the first active mode;

wherein detection of less than full physical contact of the headset with the user causes the application to switch to the second active mode;

wherein the first active mode entails full use and/or operation of the service and the second active mode entails modified use and/or operation of the service; and wherein the device is used for listening to a radio broadcast or podcast, wherein the first active mode-corresponds to playing the radio broadcast or podcast to the user in real time through speakers in the headset, wherein the detection of less than full physical contact of the headset with the user causes the application to switch to the second active mode such that the radio broadcast or podcast is recorded in the device.

2. The arrangement of claim 1, wherein the first active mode corresponds to full operation of a microphone and speakers of the headset and wherein when the application switches to the second active mode, audio signals from the microphone of the headset are discarded so as to mute the microphone of the headset.

3. The arrangement of claim 1, wherein a subsequent detection of full physical contact of the headset with the user causes the application to start a playback of the recorded radio broadcast or podcast from a point in time when less than full physical contact of the headset with the user was detected.

4. The arrangement of claim 1, wherein the first active mode corresponds to operating speakers of the headset in stereo and wherein the detection of less than full physical contact of the headset with the user causes the application to switch to the second active mode corresponding to operating speakers of the headset in mono.

5. An arrangement in a device for use with a service involving play out of audio from a headset having two earpieces, comprising:

an application for providing the play out of audio to a user of the device, wherein the application has at least two modes of operation including a first active mode and a second active mode;

wherein the first active mode corresponds to the headset being in full physical contact with the user corresponding to the two earpieces being in full physical contact with the user;

wherein the second active mode corresponds to the headset being in less than full physical contact with the user corresponding of the two earpieces being removed from an ear of the user;

wherein detection of full physical contact of the headset with the user causes the application to be in the first active mode;

wherein detection of less than full physical contact of the headset with the user causes the application to switch to the second active mode;

wherein the first active mode entails full use and/or operation of the service and the second active mode entails modified use and/or operation of the service; and wherein the first active mode corresponds to playing out audio from the headset using a first bitrate and/or a first compression scheme and wherein the detection of less than full physical contact of the headset with the user causes the application to switch to the second active mode such that the audio is played out from a speaker in the device using a second bitrate and/or a second compression scheme.

6. A method for controlling play out of audio from a headset having two earpieces connected to a user device, the method comprising;

detecting full physical contact of the headset with a user corresponding to the two earpieces being in full physical contact with the user or less than full physical contact of the headset with a user corresponding to at least one of the earpieces being removed from an ear of the user, wherein the detection of full physical contact of the headset with the user causes an application in the user device to operate in a first active mode, which allows full use and/or operation of the play out of audio;

wherein the detection of less than full physical contact of the headset with the user causes the application in the user device to operate in a second active mode, which allows modified use and/or operation of the play out of audio; and wherein the user device is used for listening to a radio broadcast and the first active mode corresponds to playing the radio broadcast to the user in real time through speakers in the headset and wherein the detection of less than full physical contact of the headset with the user causes the application to switch to the second active mode such that the radio broadcast is recorded in the device.

7. The method of claim 6, wherein the first active mode corresponds to full operation of a microphone and speakers of the headset-and wherein when the application switches to the second active mode, audio signals from the microphone of the headset are discarded to mute the microphone of the headset.

8. The method of claim 6, wherein a subsequent detection of full physical contact of the headset with the user causes the application to start a playback of the recorded radio broadcast from the point in time when less than full physical contact of the headset with the user was detected.

9. The method of claim 6, wherein the detection of full physical contact of the headset with the user causes the application to be in the first active mode corresponding to operating speakers of the headset in stereo and wherein the detection of less than full physical contact of the headset with the user causes the application to switch to the second active mode-corresponding to operating speakers of the headset in mono.

10. A method for controlling play out of audio from a headset having two earpieces connected to a user device, the method comprising;

detecting full physical contact of the headset with a user corresponding to the two earpieces being in full physical contact with the user or less than full physical contact of the headset with a user corresponding to at least one of the earpieces being removed from an ear of the user, wherein the detection of full physical contact of the headset with the user causes an application in the user device to operate in a first active mode, which allows full use and/or operation of the play out of audio;

wherein the detection of less than full physical contact of the headset with the user causes the application in the user device to operate in a second active mode, which allows modified use and/or operation of the play out of audio; and wherein the detection of full physical contact of the headset with the user causes the application to operate in the first active mode corresponding to playing out audio from the headset using a first bitrate and/or a first compression scheme and wherein the detection of less than full physical contact of the headset with the user causes the application to switch to the second active mode, wherein the audio is played out from a speaker in the device using a second bitrate and/or a second compression scheme.

* * * * *

UNITED STATES PATENT AND TRADEMARK OFFICE

CERTIFICATE OF CORRECTION

PATENT NO. : 8,908,878 B2
APPLICATION NO. : 13/512433
DATED : December 9, 2014
INVENTOR(S) : Hägglund et al.

It is certified that error appears in the above-identified patent and that said Letters Patent is hereby corrected as shown below:

In the claims

In Column 8, Line 7, in Claim 5, delete "corresponding of the" and insert -- corresponding to at least one of the --, therefor.

Signed and Sealed this
Twenty-eighth Day of June, 2016

Michelle K. Lee

Michelle K. Lee
*Director of the United States Patent and Trademark Office*